US011213829B2

(12) United States Patent
Coates et al.

(10) Patent No.: US 11,213,829 B2
(45) Date of Patent: Jan. 4, 2022

(54) HIGH SLURRY DENSITY HYDRAULIC DISASSOCIATION SYSTEM

(71) Applicant: DISA, LLC, Casper, WY (US)

(72) Inventors: Eric Coates, Casper, WY (US); John Lee, Casper, WY (US)

(73) Assignee: DISA TECHNOLOGIES, INC., Casper, WY (US)

( * ) Notice: Subject to any disclaimer, the term of this patent is extended or adjusted under 35 U.S.C. 154(b) by 226 days.

(21) Appl. No.: 16/598,706

(22) Filed: Oct. 10, 2019

(65) Prior Publication Data

US 2020/0114368 A1 Apr. 16, 2020

Related U.S. Application Data

(60) Provisional application No. 62/745,156, filed on Oct. 12, 2018.

(51) Int. Cl.

| | |
|---|---|
| ***B02C 19/06*** | (2006.01) |
| ***B02C 19/00*** | (2006.01) |
| ***B02C 23/18*** | (2006.01) |
| ***B02C 23/10*** | (2006.01) |

(52) U.S. Cl.

CPC ..... *B02C 19/005* (2013.01); *B02C 19/0043* (2013.01); *B02C 23/10* (2013.01); *B02C 23/18* (2013.01)

(58) Field of Classification Search

CPC ..... B02C 19/065; B02C 19/066; B02C 19/06; B02C 19/0043; B02C 19/005; B02C 123/10; B02C 123/18

See application file for complete search history.

(56) References Cited

U.S. PATENT DOCUMENTS

| | | | | |
|---|---|---|---|---|
| 5,129,586 | A * | 7/1992 | Artemjev | B02C 15/00 241/119 |
| 5,451,376 | A * | 9/1995 | Proksa | B02C 19/066 422/131 |
| 8,646,705 | B2 | 2/2014 | Coates et al. | |
| 8,808,661 | B2 * | 8/2014 | Logue | B02C 23/02 423/561.1 |
| 9,815,066 | B2 | 11/2017 | Coates et al. | |
| 9,914,132 | B2 | 3/2018 | Coates et al. | |
| 10,532,361 | B2 * | 1/2020 | Moldovan | B02C 19/06 |
| 2014/0308443 | A1 * | 10/2014 | Logue | B02C 19/068 427/220 |
| 2018/0141053 | A1 * | 5/2018 | Baldwin | B02C 19/066 |

* cited by examiner

*Primary Examiner* — Faye Francis

(57) ABSTRACT

A comminution system for heterogeneous materials includes pumps, a source of liquid in fluid communication with the pumps, a source of heterogeneous material, a mixer to combine the heterogeneous material and the liquid, and nozzles in fluid communication with the pumps, respectively. The pumps are in straight-line alignment with the nozzles. The nozzles receiving the heterogeneous material combined with the liquid direct the combined slurry to an impact zone where the fractions of the heterogeneous material are disassociated.

6 Claims, 1 Drawing Sheet

HIGH SLURRY DENSITY HYDRAULIC DISASSOCIATION SYSTEM

BACKGROUND OF THE INVENTION

The field of the present invention is hydraulic disassociation processes and equipment for heterogeneous materials.

Several systems exist to disassociate composite materials into discrete fractions using high energy impact of such materials in slurries directed through nozzles. Typically, a pump generates a high energy fluid stream. Composite material is added to the fluid before or after the pump to create the slurry. The output flow from the pump is divided into multiple streams that feed the nozzles in the system. The nozzles are oriented to direct the high energy slurry streams against a hard surface or against each other to create the disassociating impact. One such system is described in U.S. Pat. No. 9,815,066, the disclosure of which is incorporated herein by reference. These systems have inherent design inefficiencies. As the pump discharge is split, the discharge from the pump is circuitously directed to the nozzles. The consequence of this redirection is to create regions within the fluid conduit system that carries the process slurry from the pump discharge to the nozzle where significant wear is experienced within the fluid conduit of the system. These regions of significant wear may make necessary wear resistant solutions, such as ceramic lined piping within the system.

Such systems also have a relatively low probability of disassociating collisions experienced by the material particles being processed. This is because, by dividing the flow int multiple flow streams, the energy in each flow stream and, therefore, the slurry carrying capacity in each flow stream is reduced. Consequently, the most efficient slurry density of such systems is approximately 20 percent by mass solids. This means that 80-percent of the cross-sectional area of the material exiting the system nozzles is water, and not the material being processed. As a result, a statistical particle has, at a 20-percent operating slurry density, a 4-percent probability of an ideal particle-to-particle collision. Increasing the slurry density at which the system can operate can significantly increase the probability of disassociating particle-to-particle collisions. Therefore, higher densities of mass solids are needed to increase particle-to-particle collisions and increase disassociation efficiency. The low slurry density of such systems also requires pumping greater volumes per solids mass, increasing pumping energy requirements.

SUMMARY OF THE INVENTION

The present invention is directed to a device and method for disassociating heterogeneous material into that material's discrete fractions. To accomplish this, the system applies hydraulics to energize and accelerate ore or other heterogeneous materials in a slurry using individual pumps paired and aligned with nozzles. The material is broken apart into its discrete fractions in an impact zone. The method is for the processing of such material and the device enables the process.

Accordingly, it is a principle object of the present invention to provide enhanced equipment and process for the disassociation of heterogeneous materials.

DETAILED DESCRIPTION OF THE PREFERRED EMBODIMENTS

Figure 1:
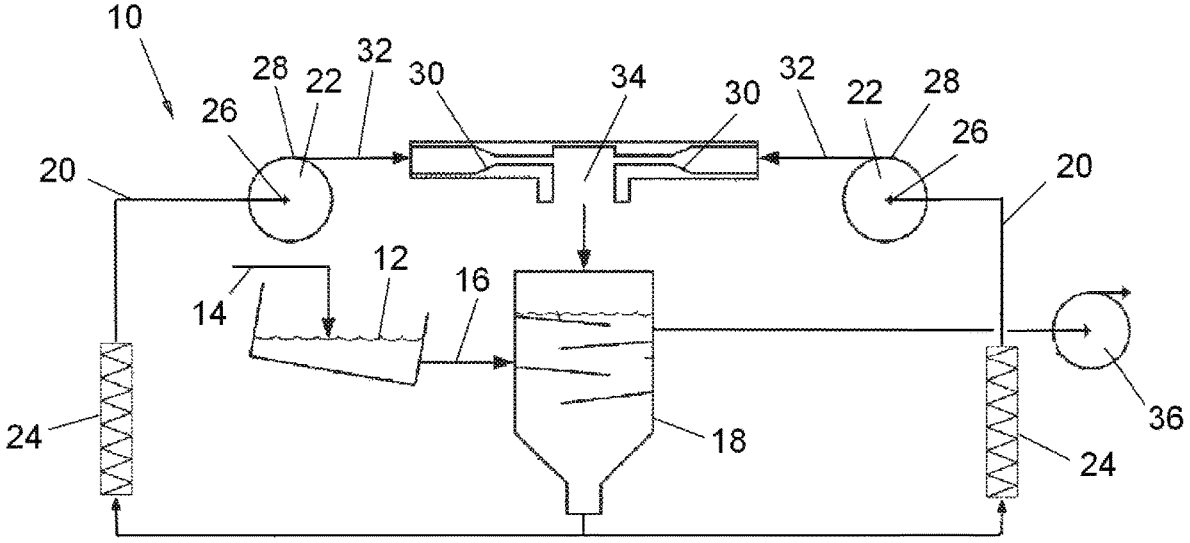
FIG. 1 is a schematic of a first comminuting machine.

Described herein is a system and method for disassociating a composite material into that material's discrete fractions. To accomplish this, the operating principle is to create high-velocity streams of the composite material suspended in a fluid. These streams are directed in such a way that they either impact each other or impact a ballistic target such as a hard surface, creating a high energy impact zone through which the material to be processed passes. During the collisions that occur within the zone, the individual particles undergo a process of distortion and rebound. The individual discrete fractions distort at different rates. This differential distortion causes the heterogeneous particles to disassociate along the boundaries between the discrete fractions. The principle goal of hydraulic disassociation is to promote or enable the mechanical isolation of any individual discrete fraction of the source material.

A slurry advantageously employed for the system to operate is created by fluid being mixed with the material to be disassociated. The fluid may be water, a reagent, oil, or any other fluid that may be appropriate for the application. The slurry may also contain additives, such as a surfactant or chemical, that may aid in the process of disassociation or the subsequent isolation of a discrete subfraction of the material, the target fraction, from the nontarget fractions of the material being processed. Several methods may be used to create this slurry, including continuously adding material to be disassociated to the fluid (and, if the application warrants, any additive) into which the material will be suspended. The slurry may also be formed by adding material already partially processed through the system, thereby creating a combined feedstock of partially processed and unprocessed material. The portion of the system that creates the slurry is called the mixing system, or mixer.

The pump-nozzle assembly is that portion of the system that draws the slurry created by the mixing system and passes it through one or more nozzles. The nozzles are oriented in such a way that the discharge of one nozzle impacts either with a ballistic target, such as the hard surface of a plate, or the discharge of one or more nozzles. The nozzles may directly oppose an opposite nozzle or be offset such that the discharge of one nozzle impacts the discharge of one or more other nozzles in such an orientation that the nozzles do not directly oppose each other.

Each nozzle in the system described is fed by a pump in fluid communication with the mixing system, either directly or through another comminuting system when such systems are used in series. These pumps energizing the fluid stream may be mounted to minimize both energy usage and wear within the system while maximizing the operating slurry density of the system. One configuration would be to have an intake port of the pump placed below the mixing system and oriented such that material from the mixing system is drawn directly into the pump. A second configuration would be to have the intake port of the pump receive the fluid with the mixing system adding the heterogeneous material after the pump. The pump includes a discharge port oriented in straight-line alignment with the nozzle for discharging the energized fluid stream thereto. The nozzle either is directly affixed to the pump or coupled to it by means of a fluid conduit.

In the preferred embodiments, there are paired pump nozzle assemblies. One critical limitation of prior art, such as the system described in U.S. Pat. No. 9,815,066, is internal wear within the fluid conduits on the discharge side of the system. The design of systems based on the concept of splitting the discharge from a pump or pumps into a plurality of flows, each of which feeds a nozzle, creates zones of high friction within the fluid conduit where the flow is redirected. This wear is a critical limitation of the system, with wear rates approaching 0.001 inch per hour being experienced at critical points within such a system in real world testing. To address this in the system described here, each pump is paired with a nozzle and oriented in such a way that the discharge from the pump is in a straight-line alignment with the discharge axis of the nozzle. To accommodate equipment, straight-line alignment may include small deviations in the range of 5 degrees between the pump discharge and the nozzle. By eliminating any significant post pump redirection of the slurry between the pumps and the discharge nozzles, this design minimizes the propensity for wear within the system. Further, by placing the pumps in the described orientation, the optimal slurry density of the system could be increased to near the maximum operating slurry density of the pump, which could be as high as 70 percent by mass solids.

The discharge capture system captures the post-high-impact zone discharge from the pump-nozzle assembly. This portion of the system either passes the discharge back into the mixing system or discharges it out of the system. The discharge capture assembly may also pass the material discharged out of the system described in this application to subsequent separation technologies, such as screening.

The system described may be configured in multiple ways. In one configuration, the system may be operated as a single stage such that the material entering and exiting the system does so in a single pass. In other configurations, several systems may be arranged in series such that the output from one system enters a second system for additional processing. In another configuration, the discharge of the system may be reintroduced into the mixing assembly of the system such that it may be reprocessed, passing again through the pump-nozzle assemblies and the high-energy impact zone.

In addition, the system may include subcomponents designed for the specific processing of specific materials. One example of such a subcomponent could be a plasma oxidation system. Plasma oxidation has been used in the reclamation of hydrocarbon contaminated sands and soils as a way of breaking down the hydrocarbons in these materials. As such, if the principle application of the system described in this application is hydrocarbon reclamation, then such a plasma oxidation subcomponent could be incorporated to promote or enhance the reclamation of the material being processed. Similarly, if the goal of the system is precious metal recovery, then the system could incorporate a reagent introduction system and carbon recovery system or circuit in such a way that the reagent that would take the precious metal into solution; and, after processing, the carbon recovery circuit is used to extract the absorbed precious metal from the process solution. These examples should be read as description and not limiting as the system is flexible enough in design to incorporate any number of subcomponents depending on the application.

Not specifically identified or described in this application are components incorporated into the system that one skilled in the art would know and understand as necessary for both design and operation. Such components may include, but are not limited to, framing, necessary to mount the components of the system, power and control systems such as variable frequency drives to operate pumps and other motive equipment required within the system, sensing elements such as flow meters, and mass sensors, all of which may, depending on the application, be advantageous to power, control and operate the system continuously.

To address wear, the system presented in this application envisions having multiple pumps in fluid communication with the mixing tank. These pumps may be located beneath the tank, or in any other location of convenience. Each pump feeds one nozzle. In addition, the pump is oriented such that the output of the pump is in a straight-line alignment with the nozzle. In orienting the pump within the system in this way, points of wear, such as bends and splits, are eliminated.

Turning to the specific embodiments, FIG. 1 schematically illustrates a comminution machine 10 including a source of heterogeneous material 12 and a source of liquid 14. A mixer 16 then directs the material and liquid as a slurry from the sources 12, 14. As this first machine 10 includes recirculation of partially processed heterogeneous material, a tank 18 receives both the liquid and the heterogeneous material in a slurry from the mixer 16. The slurry, including recycled partially processed material, is in communication through conduits 20 to pumps 22 through flow mixing devices 24. The pumps 22 have intake ports 26 receiving the slurry through the conduits 20 and discharge ports 28. Nozzles 30 are in communication with the discharge ports 28 through pipes 32 to direct flow at an impact zone 34. The nozzles 30 are in communication with and in straight-line alignment with the pump discharge ports 28 to receive the energized flow from the pumps 22. The direction may be arranged to cause the energized slurry streams to mutually converge to impact one another or impact the hard surface in the impact zone 34. The disassociated material and liquid then return from the impact zone 34 to the tank 18. A portion of the heterogeneous material and the liquid are then taken from the tank for separation through a transfer pump 36.

Figure 2:
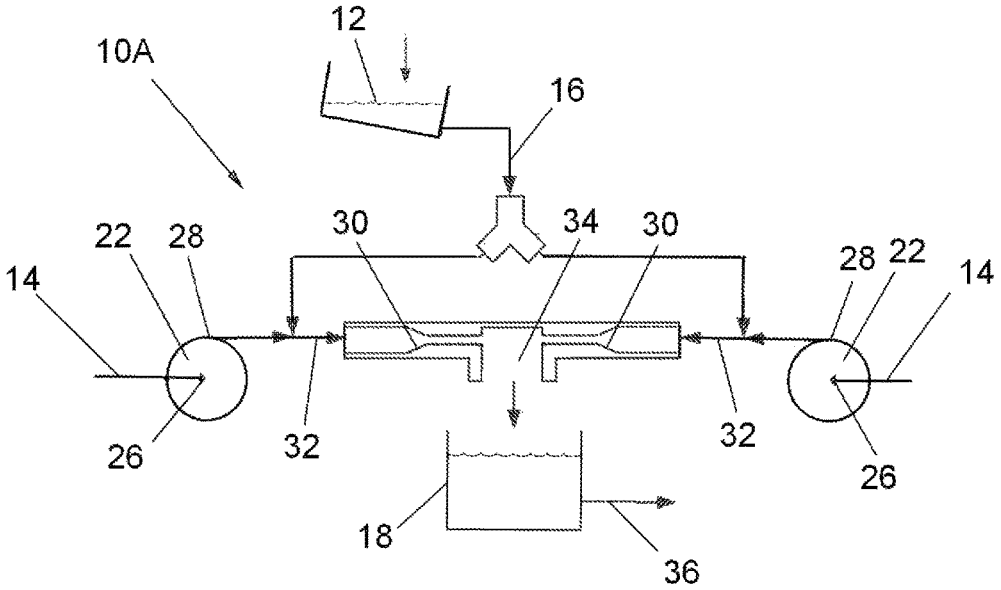
FIG. 2 is a schematic of a second comminuting machine.

FIG. 2 schematically illustrates a comminuting machine 10A. Unlike the comminuting machine 10 of FIG. 1, the comminuting machine 10A does not include recirculation of partially processed heterogeneous material. The system includes a source of heterogeneous material 12 and a source of liquid 14. The liquid from the source of liquid 14 extends to each pump 22, in communication with the pump intake ports 26. The pumps 22 energize the liquid, which is then discharged through the discharge ports 28 to the nozzles 30. A mixer 16 directs the heterogeneous material to be entrained into the energized liquid streams in between the pumps 22 and the nozzles 30 to create a slurry directed to the nozzles 30. The nozzles 30 are in communication with the discharge ports 28 through pipes 32 to direct flow at the impact zone 34. The nozzles 30 are in communication with and in straight-line alignment with the pump discharge ports 28 to receive the energized flow from the pumps 22. Again, the direction may be arranged to cause the energized slurry streams to mutually converge to impact one another or impact the hard surface of or in the impact zone 34. The comminuted material and liquid then flow from the impact zone 34 to a tank 18. The heterogeneous material and the liquid are then taken from the tank for separation through a transfer 36.

With these comminution machines 10, the process described above can be performed to dissociate fractions of heterogeneous materials. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A machine for disassociating fractions of heterogeneous materials, comprising pumps including intake and discharge ports;

a source of liquid in fluid communication with the pumps, a source of heterogeneous material;

a mixer receiving the heterogeneous material from the source of heterogeneous material and in fluid communication with the source of liquid to combine the heterogeneous material and the liquid;

nozzles in fluid communication with the discharge ports of the pumps, respectively, the discharge ports being in a straight-line alignment with the nozzles, respectively, the nozzles receiving the heterogeneous material combined with the liquid;

an impact zone toward which the nozzles are directed.

2. The machine of claim 1 further comprising straight pipes between the discharge ports and the nozzles, respectively.

3. The machine of claim 1, the mixer being in communication with the liquid between the pumps and the nozzles.

4. The machine of claim 1, the mixer being in communication with the intake ports of the pump.

5. The machine of claim 1, the impact zone being an area toward which the nozzles are directed for the liquid from the nozzles to mutually converge.

6. The machine of claim 1, the impact zone being an area toward which the nozzles are directed for the liquid from the nozzles to impact against a hard surface.

* * * * *